US011299388B1

(12) United States Patent
McNall

(10) Patent No.: US 11,299,388 B1
(45) Date of Patent: Apr. 12, 2022

(54) LIVESTOCK HALTER

(71) Applicant: Mary E. McNall, Varysburg, NY (US)

(72) Inventor: Mary E. McNall, Varysburg, NY (US)

( * ) Notice: Subject to any disclaimer, the term of this patent is extended or adjusted under 35 U.S.C. 154(b) by 0 days.

(21) Appl. No.: 17/072,307

(22) Filed: Oct. 16, 2020

(51) Int. Cl.
*B68B 1/02* (2006.01)

(52) U.S. Cl.
CPC ..... *B68B 1/02* (2013.01)

(58) Field of Classification Search
CPC ..... B68B 1/02
USPC ..... 54/24, 85
See application file for complete search history.

(56) References Cited

U.S. PATENT DOCUMENTS

| | | | | | |
|---|---|---|---|---|---|
| 100,031 | A * | 2/1870 | Harris | B68B 1/02 | 54/24 |
| 264,178 | A * | 9/1882 | Marker | B68B 1/04 | 54/6.2 |
| 280,237 | A * | 6/1883 | Porter | B68B 1/02 | 54/24 |
| 1,325,061 | A * | 12/1919 | Veal | B68B 1/02 | 54/24 |
| 4,502,265 | A * | 3/1985 | Horrigan | B68B 1/02 | 54/24 |
| 4,524,569 | A | 6/1985 | Hanna | | |
| 5,086,611 | A * | 2/1992 | Purdy | B68B 1/02 | 54/24 |
| 7,340,874 | B2 | 3/2008 | Bechtold | | |
| 7,418,810 | B2 | 9/2008 | Barnes | | |
| 7,845,150 | B2 | 12/2010 | Gibbons | | |
| 8,448,415 | B2 | 5/2013 | Grant | | |
| 9,216,896 | B1 | 12/2015 | Hegland | | |
| 9,346,664 | B2 | 5/2016 | Krickeberg | | |
| 9,487,385 | B2 | 11/2016 | Miles | | |
| 2013/0160409 | A1* | 6/2013 | Crothers | B68B 1/02 | 54/24 |

OTHER PUBLICATIONS

Halter—All Miniature Donkey Halter (Medium) ¾" Patterns USA Miniature Mini Mule Foal. Product Listing [online]. © 1996-2020, Amazon.com, Inc. [retrieved on Jul. 6, 2020]. Retrieved from the Internet: <URL: https://www.amazon.com/Halter-All-Miniature-Donkey-HalterPatterns/dp/B083QSFG68?th=1>.

Driving Halter. Product Listing [online]. Copyright © 2020 Useful Lama Items, Inc. [retrieved on Jul. 6, 2020]. Retrieved from the Internet: <URL: https://www.useful-items.com/product-p/041h.htm>.

* cited by examiner

*Primary Examiner* — David J Parsley
*Assistant Examiner* — Danielle A Clerkley
(74) *Attorney, Agent, or Firm* — Cramer Patent & Design, PLLC; Aaron R. Cramer

(57) ABSTRACT

The livestock halter may comprise a headstall, a noseband, a throatlatch, a connecting strap, a left cheekpiece, a right cheekpiece, coupled via a plurality of connecting rings to form headgear adapted to be worn by livestock. As non-limiting examples, the livestock may be equines or camelids. The headstall may be adapted to be detachable at one end for donning the halter such that the headstall is not forced over ears of the livestock. A crown buckle for adjusting the fit of the headstall may be located on the right side of the halter such the crown buckle does not interfere with the operation of a closure snap. A tie ring for connecting a lead rope may be a tie-down ring instead of a traditional ring and triangle for increased strength and easier sliding.

3 Claims, 8 Drawing Sheets

LIVESTOCK HALTER

RELATED APPLICATIONS

Non-applicable.

FIELD OF THE INVENTION

The present invention relates generally to a halter for livestock.

BACKGROUND OF THE INVENTION

The common halter used on domesticated animals is a familiar site around farms, ranches, zoos, and stables the world over. Even though it has changed little in generations, it does not mean it is not without its faults. Perhaps two of the largest problems is that it is somewhat difficult to put on and take off of animals with large ears. Not only is such a process difficult for animals such as donkeys, mules, llamas, alpacas, and similar animals, it is problematic for the care provider as well.

The other issue is the lack of adjustability and the necessity to move from one side of the animal to the other during the adjusting process. This not only takes more time, but certainly causes stress and aggravation for the care provider and many even do the same for the animal. Accordingly, there exists a need for a means by which the common halter can be modified to address the above-mentioned problems. The development of the Livestock Halter fulfills this need.

SUMMARY OF THE INVENTION

The principles of the present invention provide for a livestock halter having a headstall having a first end and a second end. The headstall is detached at the first end of the livestock halter such that the headstall is not forced over the ears of a livestock animal. The headstall is a strap that is adapted to pass over the head of the livestock animal behind its ears. The livestock halter also has a crown buckle which adjusts the headstall and is disposed on a first side of the livestock halter such that the crown buckle does not interfere with the operation of a closure snap. The crown buckle is a detachable fastener located on the headstall. The livestock halter also has a tie down ring, instead of a traditional ring and triangle, for increased strength and easier sliding. The livestock halter also has a noseband which has a nosepiece and a chin piece. The noseband encircles a muzzle of the livestock. The nosepiece is a strap that is adapted to pass over the muzzle of the livestock animal and the chin piece is a strap that is adapted to pass under the muzzle of the livestock animal.

The livestock halter also has a throatlatch which has a strap that is adapted to pass under the head of the livestock animal and a connecting strap which is adapted to pass under the muzzle of the livestock animal. The rear end of the connecting strap is slidably coupled to the throatlatch via a self-loop and the front end of the connecting strap is coupled to the tie ring via a self-loop. The livestock halter also has a left cheekpiece which is adapted to pass along the left side of the muzzle of the livestock animal. The rear end of the left cheekpiece is coupled to the left rosette ring via a self-loop. The front end of the left cheekpiece is coupled to the left noseband ring via a self-loop.

The livestock halter also has a right cheekpiece which is adapted to pass along the right side of the muzzle of the livestock animal. The rear end of the right cheekpiece is coupled to the right rosette ring via a self-loop. The front end of the right cheekpiece is coupled to the right noseband ring via a self-loop. The livestock halter also has a plurality of connecting rings which couple the headstall, the throatlatch, the noseband, the connecting strap, the left cheekpiece, and the right cheekpiece to form the livestock halter adapted to be worn by the livestock animal.

The second end of the headstall may be coupled to a right rosette ring via a self-loop and the first end of the head stall may be coupled to the closure snap via a self-loop. The headstall may be divided at the crown buckle with a first portion of the headstall having a plurality of headstall apertures with a second portion of the headstall including the crown buckle. The headstall may be fastened by passing the first portion of the headstall through the crown buckle such that the first portion of the headstall weaves above and below a frame and a center bar of the crown buckle with a prong of the crown buckle engaging in one of the plurality of headstall apertures. The livestock animal may be selected from the group consisting of a horse, a mule, a donkey, a llama, an alpaca, or a zebra.

The closure snap may include a hook, a gate, and a strap loop that detachably fastens the headstall to a left rosette ring. The gate may be a spring-loaded armature that closes after the left rosette ring is within the closure snap to prevent the left rosette ring from falling out of the closure snap. The hook may be hooked onto the left rosette ring by forcing the left rosette ring into the closure snap, thereby opening the gate. The strap loop may couple the closure snap to the first end of the headstall so the headstall may be detached from the left rosette ring by pushing the gate open and unhooking the left rosette ring. The tie ring may connect the lead rope to a tie-down ring and triangle for increased strength and easier sliding. The tie down ring may be a one-piece welded combination of a pair of rings that include a first ring and a second ring.

The first ring and the second ring of the tie down ring may be circular. The ring of the tie down ring may be smaller than the first ring. The second ring may be D-shaped. The second ring may be perpendicular to the first ring. The first end of the nosepiece may be coupled to a right noseband ring via a self-loop and the left end of the nosepiece may be coupled to a left noseband ring via a self-loop. The noseband may be adjustable via a chin piece buckle located on the chin piece. The second end of the chin piece may be coupled to the second noseband ring via a self-loop and the first end of the chin piece may be coupled to the first noseband ring via a self-loop. The first end of the throatlatch may be coupled to the first rosette ring via a self-loop and the second end of the throatlatch may be coupled to the second rosette ring via a self-loop. The livestock halter may be removed by unfastening the closure snap from the left rosette ring, allowing the headstall to drop over the right side of the livestock and by pulling the noseband forward.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
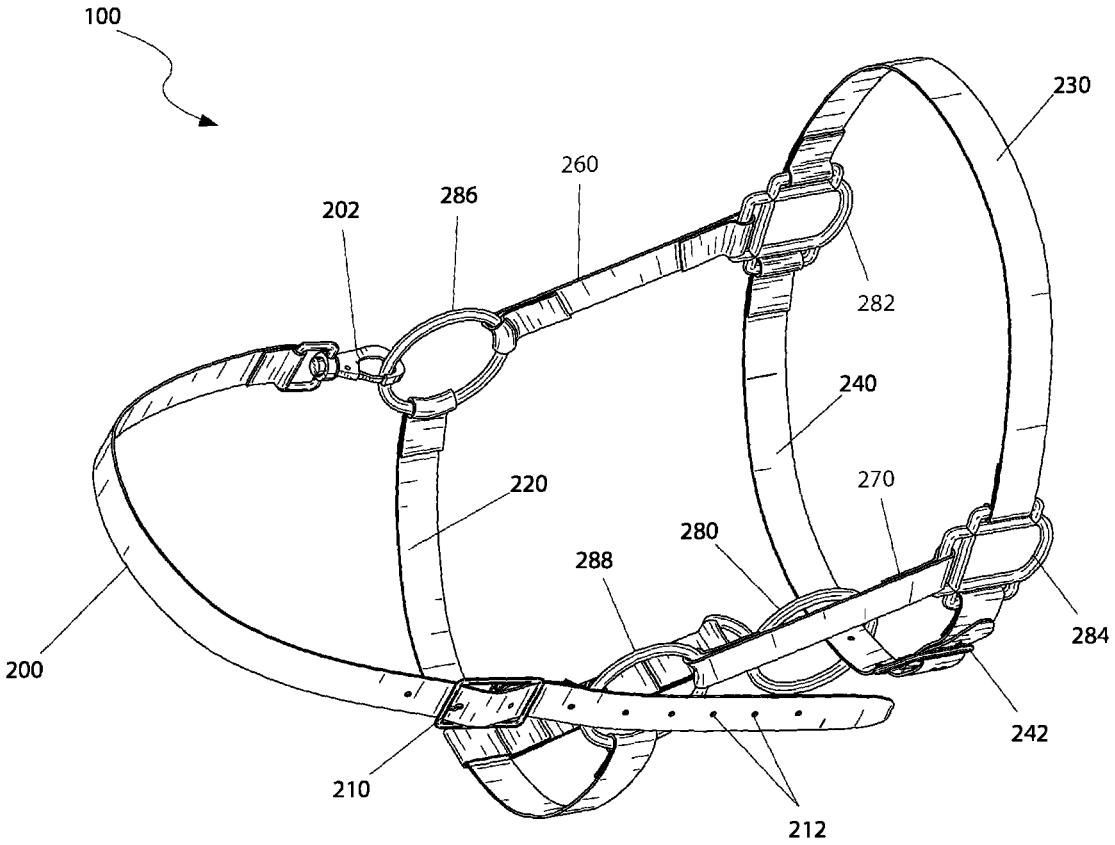
FIG. 1 is a right-side isometric view of a livestock halter, according to an embodiment of the present invention.
Figure 2:
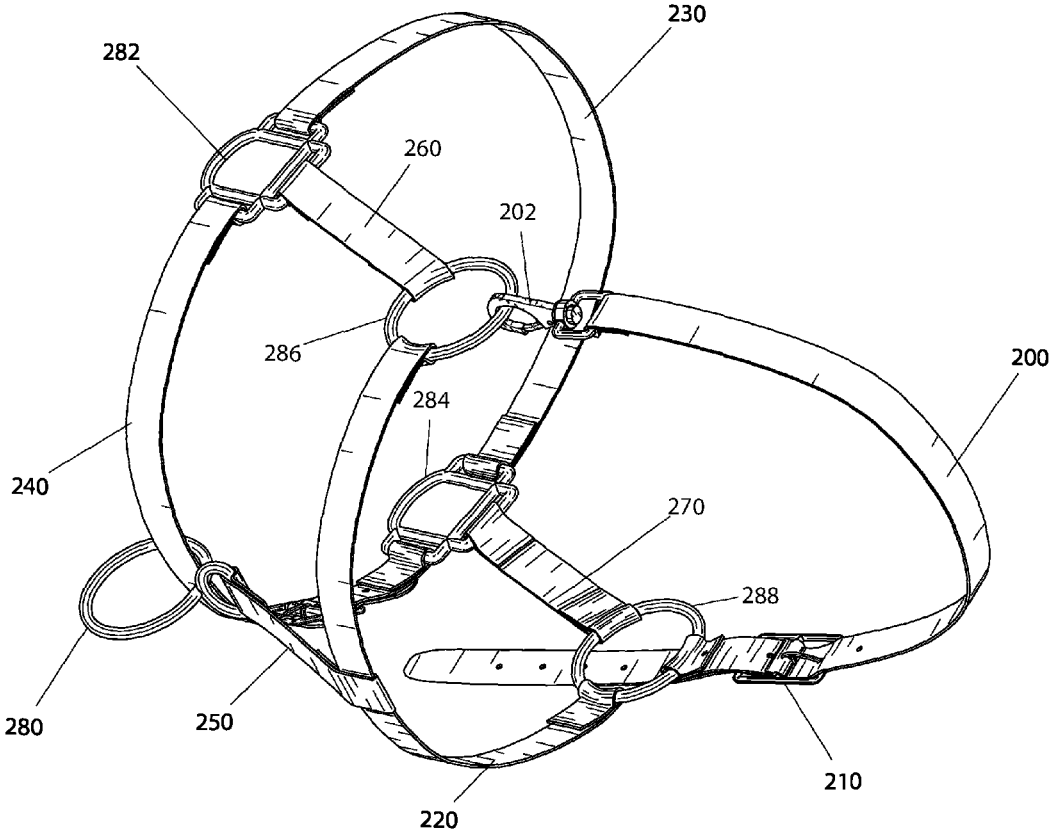
FIG. 2 is a left-side isometric view of a livestock halter, according to an embodiment of the present invention.
Figure 3:
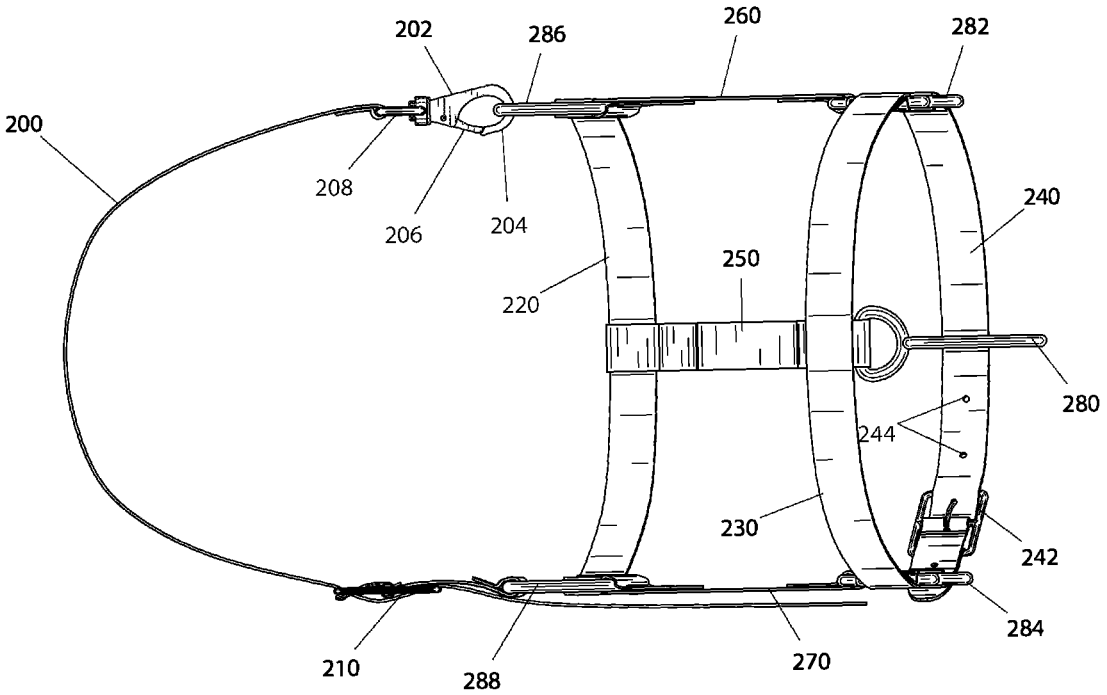
FIG. 3 is a top view of a livestock halter, according to an embodiment of the present invention.
Figure 4:
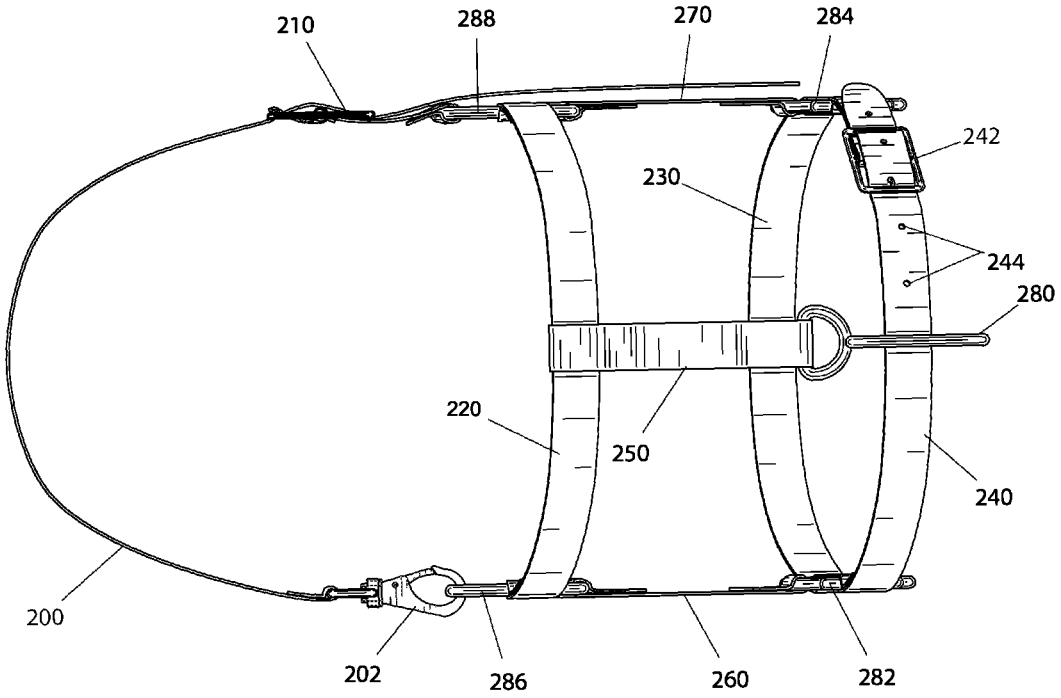
FIG. 4 is a bottom view of a livestock halter, according to an embodiment of the present invention.
Figure 5:
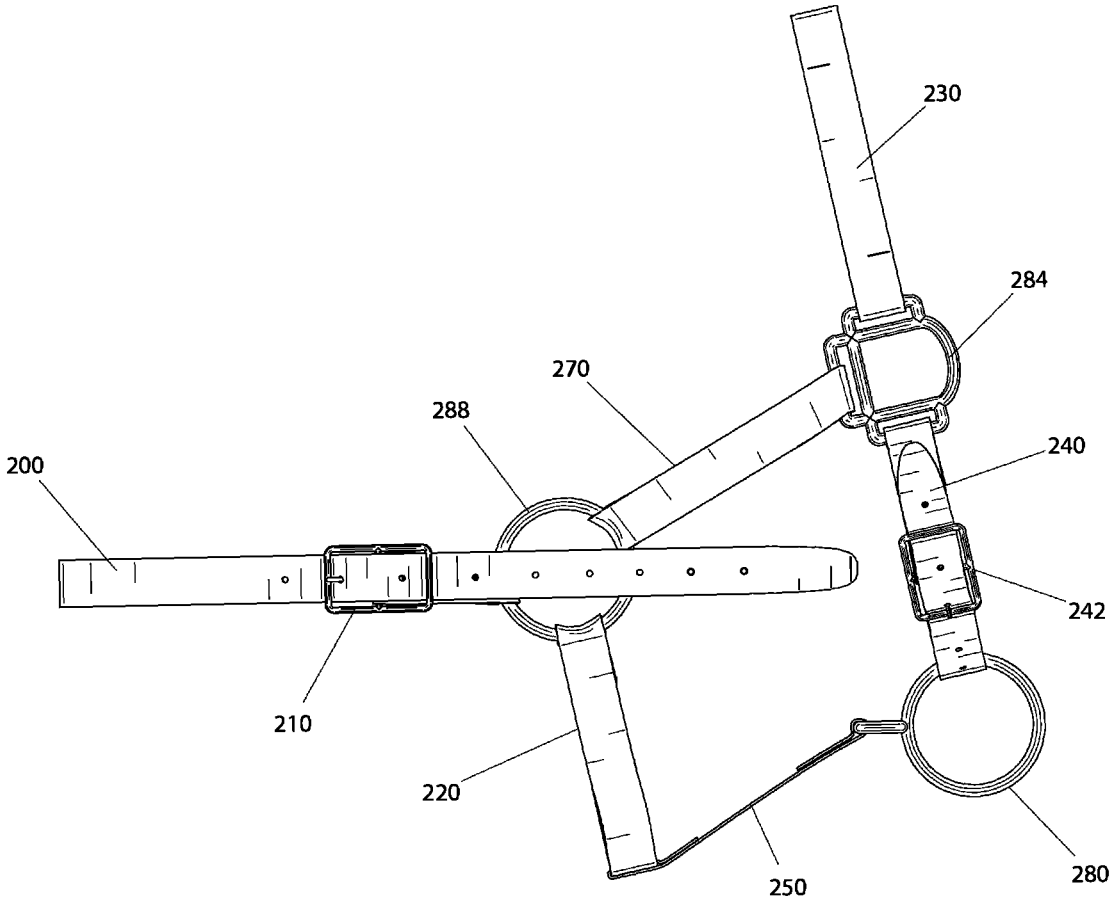
FIG. 5 is a right-side view of a livestock halter, according to an embodiment of the present invention.
Figure 6:
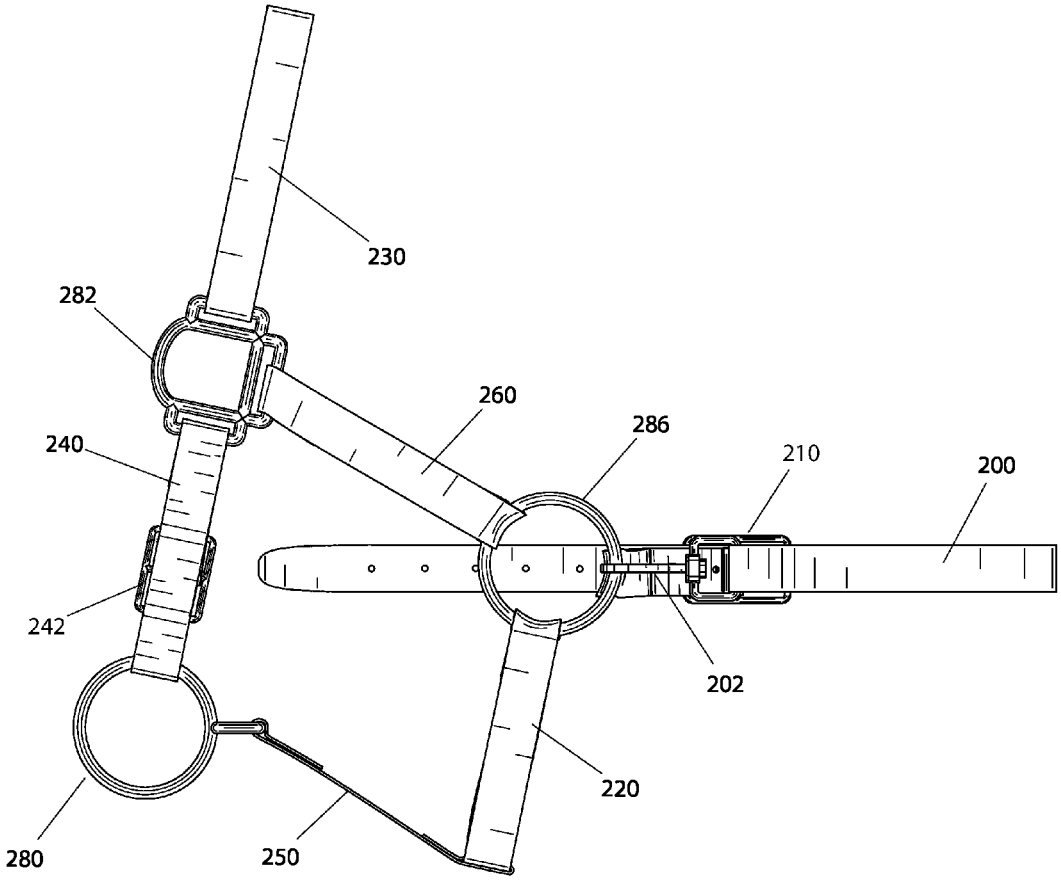
FIG. 6 is a left-side view of a livestock halter, according to an embodiment of the present invention.
Figure 7:
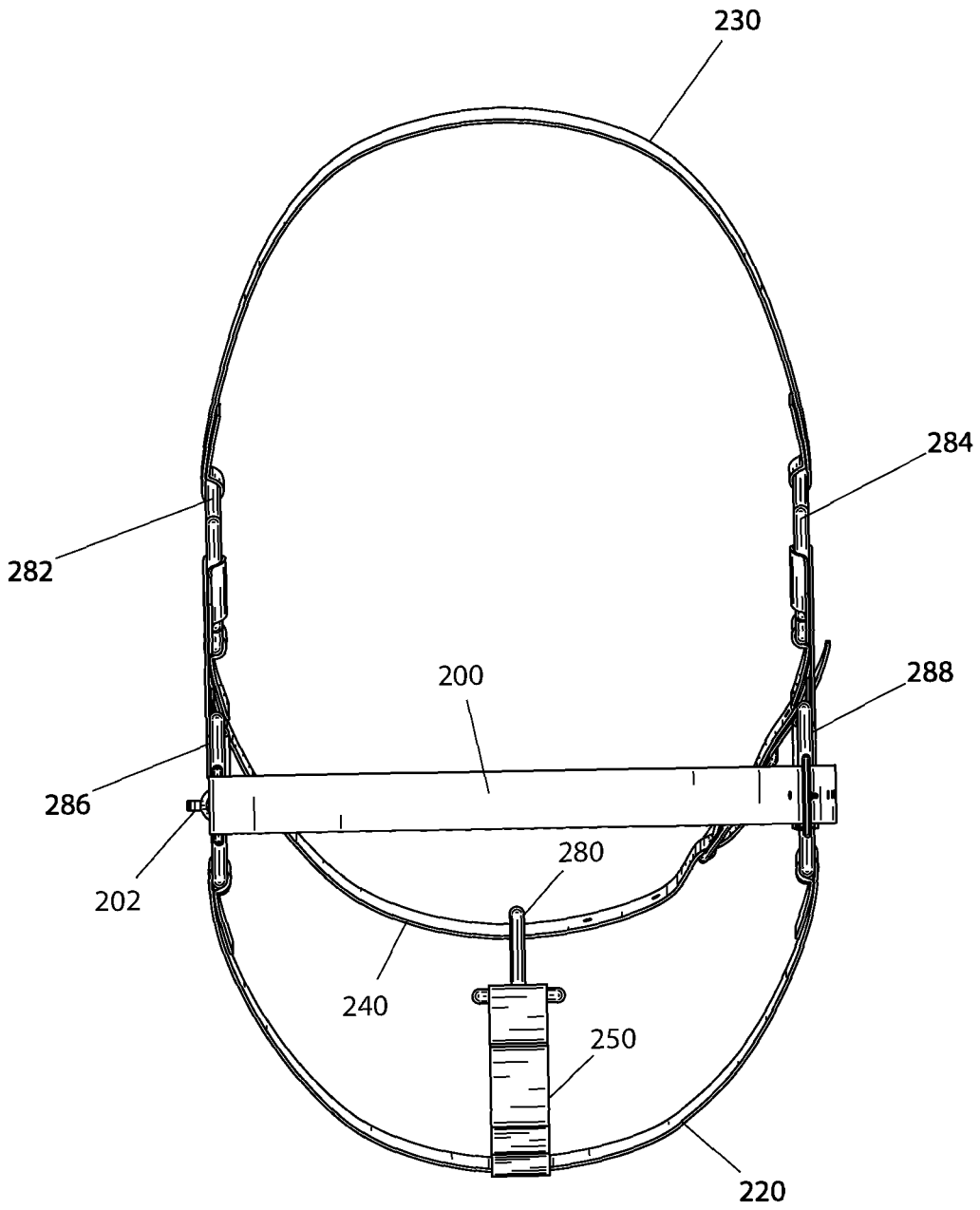
FIG. 7 is a rear view of a livestock halter, according to an embodiment of the present invention.
Figure 8:
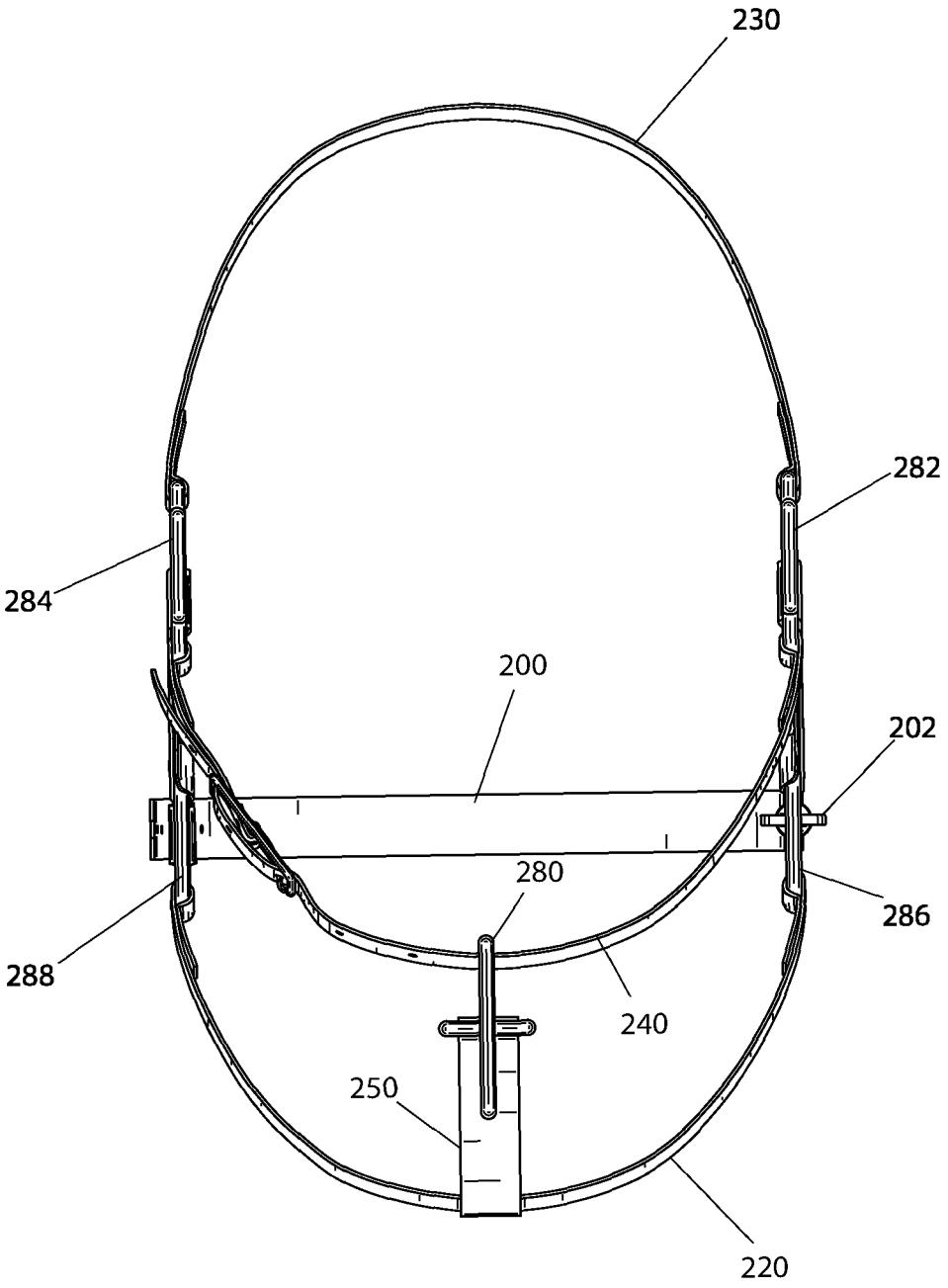
FIG. 8 is a front view of a livestock halter, according to an embodiment of the present invention.

100 livestock halter
200 headstall
202 closure snap
204 hook
206 gate
208 strap loop
210 crown buckle
212 plurality of headstall apertures
220 throatlatch
230 nosepiece
240 chin piece
242 chin piece buckle
244 plurality of chin piece apertures
250 connecting strap
260 left cheekpiece
270 right cheekpiece
280 tie ring
282 left noseband ring
284 right noseband ring
286 left rosette ring
288 right rosette ring

1. DESCRIPTION OF THE INVENTION

The present invention is directed to a livestock halter (herein described as the "invention") 100. The livestock halter 100 (hereinafter invention) may comprise a headstall 200, a noseband, a throatlatch 220, a connecting strap 250, a left cheekpiece 260, a right cheekpiece 270, and a plurality of connecting rings. The headstall 200, the throatlatch 220, the noseband, the connecting strap 250, the left cheekpiece 260, and the right cheekpiece 270 may be coupled via the plurality of connecting rings to form headgear adapted to be worn by livestock. As non-limiting examples, the livestock may be a horse, a mule, a donkey, a llama, an alpaca, or a zebra. The headstall 200 may be adapted to be detachable at one end for donning the invention 100 such that the headstall 200 is not forced over the delicate ears of the livestock. A crown buckle 210 for adjusting the fit of the headstall 200 may be located on the right side of the invention 100 such the crown buckle 210 does not interfere with the operation of a closure snap 202. A tie ring 280 for connecting a lead rope may be a tie-down ring instead of a traditional ring and triangle for increased strength and easier sliding.

As a non-limiting example, a tie down ring may be a one-piece welded combination of a two (2) rings. In some embodiments, a first ring of the tie down ring may be circular, the second ring of the tie down ring may be smaller than the first ring, the second ring may be circular or D-shaped, and the second ring may be oriented to be perpendicular to the first ring.

The headstall 200 may be a strap that is adapted to pass over a head of the livestock behind the ears. The right end of the headstall 200 may be coupled to a right rosette ring 288 via a self-loop. The left end of the headstall 200 may be coupled to the closure snap 202 via a self-loop. The headstall 200 may comprise the crown buckle 210 located on the rightmost one-quarter (¼) of the headstall 200. The crown buckle 210 may be operable to adjust the length of the headstall 200 for fit.

Throughout this document, "self-loop" may refer to the termination of a strap where the strap folds back one hundred eighty degrees (180°) and is coupled to itself such that the end of the strap forms a loop. Unless noted otherwise, the end of the strap may be bonded to itself using stitches, heat bonding, adhesives, one or more mechanical fasteners, or combinations thereof.

The closure snap 202 may comprise a hook 204, a gate 206, and a strap loop 208. The closure snap 202 may detachably fasten the headstall 200 to a left rosette ring 286. The hook 204 may be hooked onto the left rosette ring 286 by forcing the left rosette ring 286 into the closure snap 202, thereby opening the gate 206. The gate 206 may be a spring-loaded armature that closes after the left rosette ring 286 is within the closure snap 202. The gate 206 may prevent the left rosette ring 286 from falling out of the closure snap 202. The strap loop 208 may couple the closure snap 202 to the left end of the headstall 200. The headstall 200 may be detached from the left rosette ring 286 by pushing the gate 206 open and unhooking the left rosette ring 286.

The crown buckle 210 may be a detachable fastener located on the headstall 200. The headstall 200 may be divided at the location of the crown buckle 210. A first portion of the headstall 200 may comprise plurality of headstall apertures 212. A second portion of the headstall 200 may comprise the crown buckle 210. The headstall 200 may be fastened by passing the first portion of the headstall 200 through the crown buckle 210 such that the first portion of the headstall 200 weaves above and below a frame and center bar of the crown buckle 210 with a prong of the crown buckle 210 engaging in one of the plurality of headstall apertures 212. The length of the headstall 200 may be adjusted by relocating the prong to a different one of the plurality of headstall apertures 212. The headstall 200 may be unfastened by removing the first portion of the headstall 200 from the crown buckle 210.

The noseband may comprise a nosepiece 230 and a chin piece 240. The noseband may encircle a muzzle of the livestock. The fit of the noseband may be adjustable via a chin piece buckle 242 located in the chin piece 240.

The nosepiece 230 may be a strap that is adapted to pass over the muzzle of the livestock. The right end of the nosepiece 230 may be coupled to a right noseband ring 284 via a self-loop. The left end of the nosepiece 230 may be coupled to a left noseband ring 282 via a self-loop.

The chin piece 240 may be a strap that is adapted to pass under the muzzle of the livestock. The right end of the chin piece 240 may be coupled to the right noseband ring 284 via a self-loop. The left end of the chin piece 240 may be coupled to the left noseband ring 282 via a self-loop. The chin piece 240 may comprise the chin piece buckle 242 located on the rightmost one half of the chin piece 240. The chin piece buckle 242 may be operable to adjust the length of the chin piece 240 for fit.

The chin piece buckle 242 may be a detachable fastener located on the chin piece 240. The chin piece 240 may be divided at the location of the chin piece buckle 242. A first portion of the chin piece 240 may comprise a plurality of chin piece apertures 244. A second portion of the chin piece 240 may comprise the chin piece buckle 242. The chin piece 240 may be fastened by passing the first portion of the chin piece 240 through the chin piece buckle 242 such that the first portion of the chin piece 240 weaves above and below a frame and center bar of the chin piece buckle 242 with a prong of the chin piece buckle 242 engaging in one of the plurality of chin piece apertures 244. The length of the chin piece 240 may be adjusted by relocating the prong to a different one of the plurality of chin piece apertures 244. The chin piece 240 may be unfastened by removing the first portion of the chin piece 240 from the chin piece buckle 242.

The throatlatch 220 may be a strap that is adapted to pass under the head of the livestock. The right end of the throatlatch 220 may be coupled to the right rosette ring 288 via a self-loop. The left end of the throatlatch 220 may be coupled to the left rosette ring 286 via a self-loop. In some embodiments, the throatlatch 220 may comprise a throatlatch buckle as it traditionally has. In such embodiments, the throatlatch 220 may be moved to the right side of the head such that all three (3) size adjustments (e.g.; the crown buckle 210, the chin piece buckle 242, and the throatlatch buckle) are located on the right side of the head.

The connecting strap 250 may be a strap that is adapted to pass under the muzzle of the livestock. The rear end of the connecting strap 250 may be slidably coupled to the throatlatch 220 via a self-loop. The front end of the connecting strap 250 may be coupled to the tie ring 280 via a self-loop.

The left cheekpiece 260 may be a strap that is adapted to pass along the left side of the muzzle of the livestock. The rear end of the left cheekpiece 260 may be coupled to the left rosette ring 286 via a self-loop. The front end of the left cheekpiece 260 may be coupled to the left noseband ring 282 via a self-loop.

The right cheekpiece 270 may be a strap that is adapted to pass along the right side of the muzzle of the livestock. The rear end of the right cheekpiece 270 may be coupled to the right rosette ring 288 via a self-loop. The front end of the right cheekpiece 270 may be coupled to the right noseband ring 284 via a self-loop.

The plurality of connecting rings may comprise the tie ring 280, the left noseband ring 282, the right noseband ring 284, the left rosette ring 286, and the right rosette ring 288. The lead rope may be removably coupled to the tie ring 280 such that a handler may lead the livestock.

Traditionally, the handler leads the livestock from the left side. It is therefore advantageous for the invention 100 to position the closure snap 202 on the left side of the livestock. In addition, the crown buckle 210 and the chin piece buckle 242 may be advantageously positioned on the right side of the livestock where they are clear of the closure snap 202 and the lead rope. Typically, the crown buckle 210 and the chin piece buckle 242 may be adjusted just one time to fit a particular animal. Thereafter, the closure snap 202 may be operable to loosen the invention 100 for placing and removing the invention 100 on the head. By having the crown buckle 210 and the chin piece buckle 242 on the right side, the crown buckle 210 and the chin piece buckle 242 cannot interfere with the closure snap 202 located on the left side and the lead rope, attached to the tie ring 280 and usually handled from the left side.

In some embodiment, the left noseband ring 282 and the right noseband ring 284 may be three-sided halter squares. Three-sided halter squares may be halter rings that comprise a central ring with a rectangular loop projecting from three sides in orthogonal directions. Three-sided halter squares may join three (3) coplanar straps arriving from perpendicular directions. In some embodiments, the left rosette ring 286 and the right rosette ring 288 may be circular rings.

In some embodiments, the headstall 200, the throatlatch 220, the noseband, the connecting strap 250, the left cheekpiece 260, and the right cheekpiece 270 may be made from leather, nylon, coated nylon, polypropylene, or combinations thereof. In some embodiments, the tie ring 280, the left noseband ring 282, the right noseband ring 284, the left rosette ring 286, and the right rosette ring 288 may be made from brass, stainless steel, or combinations thereof.

The dimensions of the headstall 200, the throatlatch 220, the noseband, the connecting strap 250, the left cheekpiece 260, and the right cheekpiece 270 may vary to fit a variety of equines (horses, donkeys, mules, and zebras) and camelids (alpacas, and llamas) of all sizes.

In use, the invention 100 may be placed on the livestock by pulling the left rosette ring 286 and the right rosette ring 288 rearwards along the sides of the head such that the noseband slides over the muzzle, by passing the headstall 200 over the head and behind the ears, and by fastening the closure snap 202 to the left rosette ring 286. The crown buckle 210 and the chin piece buckle 242 may be adjusted, if necessary, to fit the livestock.

The invention 100 may be removed by unfastening the closure snap 202 from the left rosette ring 286, by allowing the headstall 200 to drop over the right side of the livestock, and by pulling the noseband forward.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A livestock halter, consisting of:

a headstall having a first end and a second end, the headstall detachable such that the headstall is not forced over the ears of a livestock animal, the headstall is a strap that is adapted to pass over the head of the livestock animal behind its ears;

a crown buckle adapted to adjust the headstall, the crown buckle is a detachable fastener located on the headstall;

a tie ring for increased strength and easier sliding;

a noseband having a nosepiece and a chin piece, the noseband encircles a muzzle of the livestock, the nosepiece is a strap that is adapted to pass over the muzzle of the livestock animal, the chin piece includes a first end and a second end, and the chin piece is a strap that is adapted to pass under the muzzle of the livestock animal;

a throatlatch having a strap that is adapted to pass under the head of the livestock animal;

a connecting strap adapted to pass under the muzzle of the livestock animal, the rear end of the connecting strap is slidably coupled to the throatlatch via a self-loop and the front end of the connecting strap is coupled to the tie ring via a self-loop;

a left cheekpiece adapted to pass along the left side of the muzzle of the livestock animal, the rear end of the left cheekpiece is coupled to a left rosette ring via a self-loop, the front end of the left cheekpiece is coupled to a left noseband ring via a self-loop; and a right cheekpiece adapted to pass along the right side of the muzzle of the livestock animal, the rear end of the right cheekpiece is coupled to a right rosette ring via a self-loop, the front end of the right cheekpiece is coupled to a right noseband ring via a self-loop;

wherein the tie ring, the left rosette ring, and the right rosette ring couple the headstall, couple the headstall, the throatlatch, the noseband, the connecting strap, the left cheekpiece, and the right cheekpiece to form the livestock halter adapted to be worn by the livestock animal;

wherein the headstall is divided at the crown buckle with a first portion of the headstall having a plurality of headstall apertures with a second portion of the headstall including the crown buckle;

wherein the headstall is fastened by passing the first portion of the headstall through the crown buckle such that the first portion of the headstall weaves above and below a frame and a center bar of the crown buckle with a prong of the crown buckle engaging in one of the plurality of headstall apertures;

wherein the tie ring is a one-piece welded combination of a pair of rings that include a first ring and a second ring;

wherein the second ring of the tie ring is smaller than the first ring;

wherein the second end of the headstall is coupled to the right rosette ring via a self-loop and the first end of the headstall is coupled to a closure snap via a self-loop;

wherein the closure snap includes a hook, a gate, and a strap loop that detachably fastens the headstall to the left rosette ring;

wherein the gate is a spring-loaded armature that closes after the left rosette ring is within the closure snap to prevent the left rosette ring from falling out of the closure snap;

wherein the hook is hooked onto the left rosette ring by forcing the left rosette ring into the closure snap, thereby opening the gate;

wherein the strap loop couples the closure snap to the first end of the headstall so the headstall is detached from the left rosette ring by pushing the gate open and unhooking the left rosette ring;

wherein the first ring and the second ring of the tie ring are circular;

wherein the second ring is perpendicular to the first ring;

wherein a right end of the nosepiece is coupled to the right noseband ring via a self-loop and a left end of the nosepiece is coupled to the left noseband ring via a self-loop;

wherein the second end of the chin piece is coupled to the right noseband ring via a self-loop and the first end of the chin piece is coupled to the left noseband ring via a self-loop;

wherein a first end of the throatlatch is coupled to the left rosette ring via a self-loop and a second end of the throatlatch is coupled to the right rosette ring via a self-loop; and wherein the noseband is adjustable via a chin piece buckle located on the chin piece.

2. The livestock halter, according to claim 1, wherein the livestock animal is selected from the group consisting of a horse, a mule, a donkey, a llama, an alpaca, or a zebra.

3. The livestock halter, according to claim 1, wherein a lead rope is connected to the tie ring—for increased strength and easier sliding.

* * * * *